US005813482A

United States Patent [19]

Barbera

[11] Patent Number: 5,813,482

[45] Date of Patent: Sep. 29, 1998

[54] EARTH BORING SYSTEM AND APPARATUS

[76] Inventor: Leo J. Barbera, 1835 Youngs Rd., Southern Pines, N.C. 28387

[21] Appl. No.: 578,740

[22] Filed: Dec. 26, 1995

[51] Int. Cl.[6] ..... E21B 7/06; E21B 7/20; E21D 9/08

[52] U.S. Cl. ..... 175/61; 175/62; 175/73; 175/171; 405/143

[58] Field of Search ..... 175/62, 73, 74, 175/75, 45, 171, 61; 405/143

[56] References Cited

U.S. PATENT DOCUMENTS

| | | | |
|---|---|---|---|
| 3,526,285 | 9/1970 | Adkins et al. | 175/73 |
| 3,767,836 | 10/1973 | Geis et al. | 175/24 |
| 3,851,716 | 12/1974 | Barnes | 175/62 X |
| 3,919,851 | 11/1975 | Plourde | 405/143 |
| 3,939,926 | 2/1976 | Barnes et al. | 175/24 |
| 4,013,134 | 3/1977 | Richmond et al. | 175/73 |
| 4,436,448 | 3/1984 | Magnus et al. | 405/143 |
| 4,438,820 | 3/1984 | Gibson | 175/45 |
| 4,630,967 | 12/1986 | Soltau | 405/143 |
| 4,655,493 | 4/1987 | Sumi | 405/143 X |
| 4,867,255 | 9/1989 | Baker et al. | 175/62 X |
| 5,061,120 | 10/1991 | Akesaka | 405/143 |
| 5,099,927 | 3/1992 | Gibson et al. | 175/45 |
| 5,125,768 | 6/1992 | Ilomäki | 405/150 |
| 5,203,418 | 4/1993 | Gibson et al. | 175/73 X |
| 5,470,132 | 11/1995 | Cartwright | 405/143 X |

FOREIGN PATENT DOCUMENTS

| | | | |
|---|---|---|---|
| 3505505 | 8/1986 | Germany | 175/62 |
| 0125090 | 5/1990 | Japan | 405/143 |
| 2186899 | 8/1987 | United Kingdom | 175/62 |

*Primary Examiner*—Hoang C. Dang
*Attorney, Agent, or Firm*—Robert R. Reed; Cort Flint

[57] ABSTRACT

An earth boring system is disclosed for guiding and steering a string of pipe casings to form an underground cased bore. The string of pipe casings are guided by a boring end assembly including a front casing and a steering head connected at an interface gap by a plurality of hinge assemblies each having an actuator and a pair of connector parts. A protective enclosure protects the hinge assemblies from loosened earth from the earthen bore and from the earth being removed from within the pipe casings. The protective enclosure can be formed by an inner pipe and an outer pipe of both the front casing and the steering head, plus a closure ring and a retainer belt at the interface gap. Guidance sensors are provided to determine the location of the string of pipe casings and a computer control center computes steering head axial and angular displacements for guiding the string of pipe casings and controlling the extent of the interface gap.

34 Claims, 4 Drawing Sheets

EARTH BORING SYSTEM AND APPARATUS

BACKGROUND OF THE INVENTION

This invention relates to a system for guiding and steering a string of pipe casings to form a cased bore hole underground by cutting an earthen bore and pushing the joined together pipe casings through the earthen bore with an earth boring machine. The string of pipe casings are guided by a boring end assembly having a front casing and a steering head connected by a plurality of hinge assemblies. In particular, the invention relates to a protective enclosure for protecting the hinge assemblies of the steering head from loosened earth and providing a single hydraulic manifold unit to operate a plurality of actuators of the hinge assemblies.

Earth boring machines are known which use a mechanical power unit to hydraulically ram a string of pipe casings into a hole in the earth drilled by a cutter head. The purpose of a cased bore hole is to avoid cutting a trench in the ground surface to install pipes from one location to another. The cased bore hole avoids cutting paved roadways and runways and interrupting the use of these structures. The installation of pipes through earthen dams and under buildings are other examples of the necessary use of cased bore holes in the earth. A major problem exists in starting at one location and blindly reaching a desired end location with the string of pipe casings. Instrumented front pipe sections have been used to determine a apparent location of the end of the string of pipe casings. Providing corrections to the apparent location is very difficult and provides an on-going challenge to the proper guidance of the string of pipe casings during their installation.

One method of guiding the string of pipe casings is to use a steerable head section at the front end of the string. The steerable head section is hinged for providing changes in the direction of the advancing string of pipe casings. Examples of a steerable head are disclosed in U.S. Pat. Nos. 4,013,134; 5,061,120; and 5,099,927. The earth boring machine of Richmond et al (U.S. Pat. No. 4,013,134) has a steering head that pivots up and down only using a flush type pivot hinge attached to a second casing at an interface gap. Only a single pipe casing is used along with an auger to remove loosened earth. Single acting hydraulic actuators drive the steering head using a push rod attached to the upper surface of the second casing remote from the head. Actuators and push rods are exposed to the earthen bore. A liquid level gage is used to monitor the casing elevation. Three hydraulic jacks disclosed in Akesaka (U.S. Pat. No. 5,061,120) deflect the head section of a front shield body relative to a tail portion of a front shield body of a tunneling machine. The double acting jacks are disposed behind a partition wall inside the head portion of the front shield body of the tunneling machine. Loosened earth is removed by water supply and drain pipes extending beyond the partition wall in the front section of the shield body. A rod prevents the head section from having an axial displacement relative to a tail portion. The patent by Gibson et al (U.S. Pat. No. 5,099,927) discloses another steerable head structure. The steerable head section is connected to the forward casing by compound mechanical knuckles to allow steering using motor driven screw actuators about two pivot axes. A separate drive shaft extends from the mechanical power unit to each hinge assembly. A single casing is used and the parts of the steering assembly are exposed to the earth being external to the pipe casings. The inertial guidance package provides calculated locations of the pipe using rate sensors, accelerometers and the like, and a liquid level gage is also disclosed.

It is also known to provide a hinged steerable head section which is steerable by using some means for rotating the steering head with respect to the string of pipe casings. Actuator devices are commonly used to force the steering head to rotate about a fixed linkage device that bridges the space between the steering head and the pipe casings. The fixed linkage also keeps the steering head attached to the pipe casings . A current problem exists in providing space for actuator devices without interference with the operation of the cutter head making the earthen bore and removing the excess earth from the cutting operation. In addition, the operation of the actuators devices can be fowled by the surrounding earth. One solution for providing space for the actuator devices is disclosed in U.S. Pat. Nos. 3,767,836 and 5,125,768. This solution uses an outer pipe and an inner pipe with the actuator devices between the two pipes. In the disclosure of Geis et al (U.S. Pat. No. 3,767,836), inner and outer cylinder walls of the steering head provide a chamber for an actuator control means. Guidance of the steering head is provided by three pusher shoes which are pivoted outwardly by an inclined cam device for engaging the earth surrounding the casing and deflecting a guidance casing. Loosened earth from the earthen bore can penetrate the chamber and limit the operation of the control means. The bending deflection of the guidance casing steers the pipe casings. Steering is limited by the guidance casing not being hinged to the casing members.

Geis et al further discloses an auger assembly with a cutter head having outward extending blades can fit inside the inner cylinder walls and rotate to extend radially outwardly beyond the outer cylinder wall. The patent of Ilomaki (U.S. Pat. No. 5,125,768) uses a drill head with suitable drilling tools attached to a rotating internal drum which operates on roller devices inside the assembled outer pipe of the drill head. Guidance is provided by fluid actuators located between the rotating internal drum and an outer cylindrical part of the drill head. The drilling tools are pneumatic hammers or rotating cutters placed in the drill head. Soil of the drilled tunnel is transported through a conical front portion of the internal drum and further by an internal spiral. Very limited guidance of the drill head is possible as the fluid actuators must bend the internal drum.

A further problem with the installation of a string of pipe casings is providing space and protection for supply lines which serve the forward end of the string from a pit area at the starting end of the string. These include mechanical fluids lines as well as electrical lines. Service lines transport fluids and electrical signals in both directions along the string of pipe casings. Service lines also become fowled by the presence of the surrounding earth. The existence of joints in service lines makes the fowling problem more frequent. These problems are partially solved by the disclosure of U.S. Pat. Nos. 3,939,926 and 4,438,820. The patent of Barnes et al (U.S. Pat. No. 3,939,926) discloses flexible lines from a reel assembly at the pit area to a steering head. However, components of the service lines at the steering head are exposed to the surrounding earth. A water gage means, being standard in the industry, is also disclosed by Barnes et al. The patent of Gibson (U.S. Pat. No. 4,438,820) discloses supply lines on the top of a casing pipe protected by a channel. However, this channel extends the full distance from the steering head to the pit area and no lines can extend inside the casing pipe without being damaged.

The need to properly protect components of the actuator devices and their activation means at the steering head of a string of pipe casings remains. Earthen material from the earthen bore and excess earth from the cutting operation of the cutter head are potential hazards for the proper guidance by restricting movements provided by a steering head relative to the string of pipe casings. This is especially true when actuators are connected using hinge assemblies to provide larger angular deflections of the steering head relative to the string of pipe casings during guidance maneuvers. Larger angular deflections result in a larger gap width between opposing end faces of a steering head and the adjacent pipe section. The need to protect components is associated with the need to maintain a minimum gap width.

Protecting service lines, actuator devices and activation means during installation of a string of pipe casings is made more difficult by the greater number of service lines and activation means wherein actuators are activated from the pit area. Another need remains to provide a smaller number of service lines and an activation means whereby the actuator devices are activated from a location near the front end of the string of pipe casings.

Accordingly, an object of the present invention is to provide an improved earth boring system including a boring end assembly having increased protection for hinge assemblies positioned within a front casing and steering head to provide better guidance and control of the path of a string of pipe conduits.

Another object of the present invention is to provide an earth boring system having axial displacements as well as angular displacements of a steering head relative to a front casing so that a gap width of an interface gap between the steering head and the front casing can be controlled for increased steering.

An additional object is to provide an expandable cutter head that allows a smaller diameter bore hole when boring becomes difficult, and a cutter head can be withdrawn when necessary without disturbing the string of pipe casings.

Yet another object of the present invention is to provide reduced number of service lines to a boring end assembly which are continuous from the pit area and are protected within the boring end assembly.

SUMMARY OF THE INVENTION

The above objectives are accomplished according to the present invention by providing an earth boring system having a boring end assembly which allows for steering of a string of pipe casings using hinge assemblies that are protected from damage or fowling by loosened earth both from inside the string of pipe casings and from the earthen bore outside the string. The system further includes a manifold unit to supply fluids to actuators that limits the number of service lines provided to boring end assembly from a mechanical power unit and service assembly. An adjustable diameter cutter head allows the use of inner pipes and outer pipes in a preferred embodiment of the boring end assembly to provide an annular space for the hinge assemblies.

The present invention is an earth boring system for cutting an earthen bore and installing a string of underground pipe casings joined together to form a cased bore hole in earth by pushing and guiding said string of pipe casings through said earthen bore. The system includes a mechanical power unit for forcing said pipe casings through said earthen bore. A front casing is disposed directly in front of a lead pipe casing of the string of pipe casings and the front casing includes at least an outer front casing wall. A steering head is directly in front of the front casing for guiding the string of pipe casings and the steering head includes at least an outer steering head wall. A cutter head is carried forward of the steering head for cutting the earthen bore and an earth removal channel is defined through an interior portion of the front casing and the steering head. A conveyor is associated with the cutter head for removing excess earth through the earth removal channel and the conveyor is driven by the power unit within the string of pipe casings. The system further includes an interface gap defined by opposing end faces of the outer steering head wall and the outer front casing wall to provide for axial and angular displacements of the steering head relative to the front casing within the earthen bore for guiding the string of pipe casings. A plurality of hinge assemblies connects the steering head and the front casing at a plurality of locations adjacent the interface gap for providing relative movements between the steering head and the front casing. A first connector part of each hinge assembly is associated with the front casing and a second connector part of the each hinge assembly associated with the steering head. A protective enclosure is associated with the plurality of hinge assemblies for protecting the hinge assemblies from loose earthen material cut from the earthen bore and from excess earth moving within the earth removal channel. At least one enclosure element of the protective enclosure bridges the interface gap to exclude the loose earthen material and the excess earth from entry into the protective enclosure.

In another embodiment of the present invention a boring end assembly of the earth boring system comprises a front casing disposed directly in front of a leading pipe of the pipe casings in the cased bore hole. The front casing has a first inner pipe and a first outer pipe. A steering head is directly in front of the front casing for steering the pipe casings and the has a second inner pipe and a second outer pipe. A continuous annular cavity is formed by axially aligning the first and second inner pipes and the first and second outer pipes. An outer interface gap is associated with the annular cavity defined by opposing end faces of the first and second outer pipes and an inner interface gap is associated with the annular cavity defined by opposing end faces of the first and second inner pipes. A cutter head carried forward of the steering head is for cutting the earthen bore and an earth removal channel is defined through an interior portion of the first and second inner pipes. A conveyor is associated with the cutter head for removing excess earth through the earth removal channel. The invention further comprises a plurality of hinge assemblies located within the annular cavity to connect the steering head and the front casing and provide for axial and angular displacements of the steering head relative to the front casing. A protective enclosure is associated with the annular cavity for protecting the plurality of hinge assemblies from loose earthen material cut from the earthen bore and from excess earth moving within the earth removal channel. An outer enclosure element of the protective enclosure is associated with the outer interface gap to exclude entry of the loose earthen materials into the annular cavity and an inner enclosure element of the protective enclosure is associated with the inner interface gap to exclude entry of the excess earth into the annular cavity.

In a further embodiment of the invention a front casing disposed directly in front of a lead pipe casing of the string of pipe casings has a central axis and a steering head directly in front of the front casing for guiding the string of pipe casings and has a steer axis. A cutter head carried forward of the steering head is for cutting the earthen bore and an earth removal channel is defined through at least an interior portion of the front casing and the steering head. A conveyor is associated with the cutter head for removing excess earth through the earth removal channel. The conveyor is driven by the power unit and positioned within the string of pipe casings. An interface gap between the front casing and the steering head is for displacing the steering head relative to the front casing within the earthen bore for guiding the string of pipe casings. An interface gap width associated with the interface gap is for controlling the extent of the interface gap. The embodiment further comprises a plurality of first connector parts associated with the front casing for connecting the steering head to the front casing adjacent the interface gap and a plurality of second connector parts associated with the steering head for connecting the steering head to the front casing adjacent the interface gap. A plurality of actuators are each for forcing a respective first connector part to be displaced from a respective second connector part. A plurality of actuator shafts each provide a relative movement between the steering head and the front casing by displacing the first connector parts relative to at the second connector parts. A plurality of hinges associated with the actuators provide angular movements of the second connector parts relative to the first connector parts about two axes of rotation. The plurality of second connector parts are displaced from the plurality of first connector parts an equal distance by the plurality of actuators for providing a uniform gap width. The uniform gap width is monitored for controlling a maximum distance of the interface gap width. At least one second connector part is displaced from at least one first connector parts a distance by moving at least one respective actuator shaft to provide a non-uniform gap width. The non-uniform gap width is monitored for controlling a steer angle between the central axis of the front casing and the steer axis of the steering head.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail. An earth boring system uses a mechanical power unit to install a string of underground pipe casings through the earth from a starting end to a terminal end. The pipe casings are joined together to form a cased bore hole. The passage of the pipe casings is realized by providing a bore hole using a cutter head rotated by the mechanical power unit. Loose earth from the cutter head is removed through a earth removal channel inside the string of pipe casings. Removal of the excess earth can be achieved by a combination of devices including an auger system or by transporting the excess earth suspended in a fluid such as water. The preferred removal system of this invention uses an auger which includes an auger shaft to support and rotate the cutter head. A proper direction of the advancing string of pipe casings in a earthen bore is critical for correct installation in reaching a predetermined terminal end. This direction is altered by a steering head attached to a front casing in front of the string of pipe casings. Means for altering the direction of the advancing string of pipe casings in this invention includes a hydraulic manifold unit that supplies a plurality of hinge assemblies which are protected from the earth by a protective enclosure.

Figure 1:
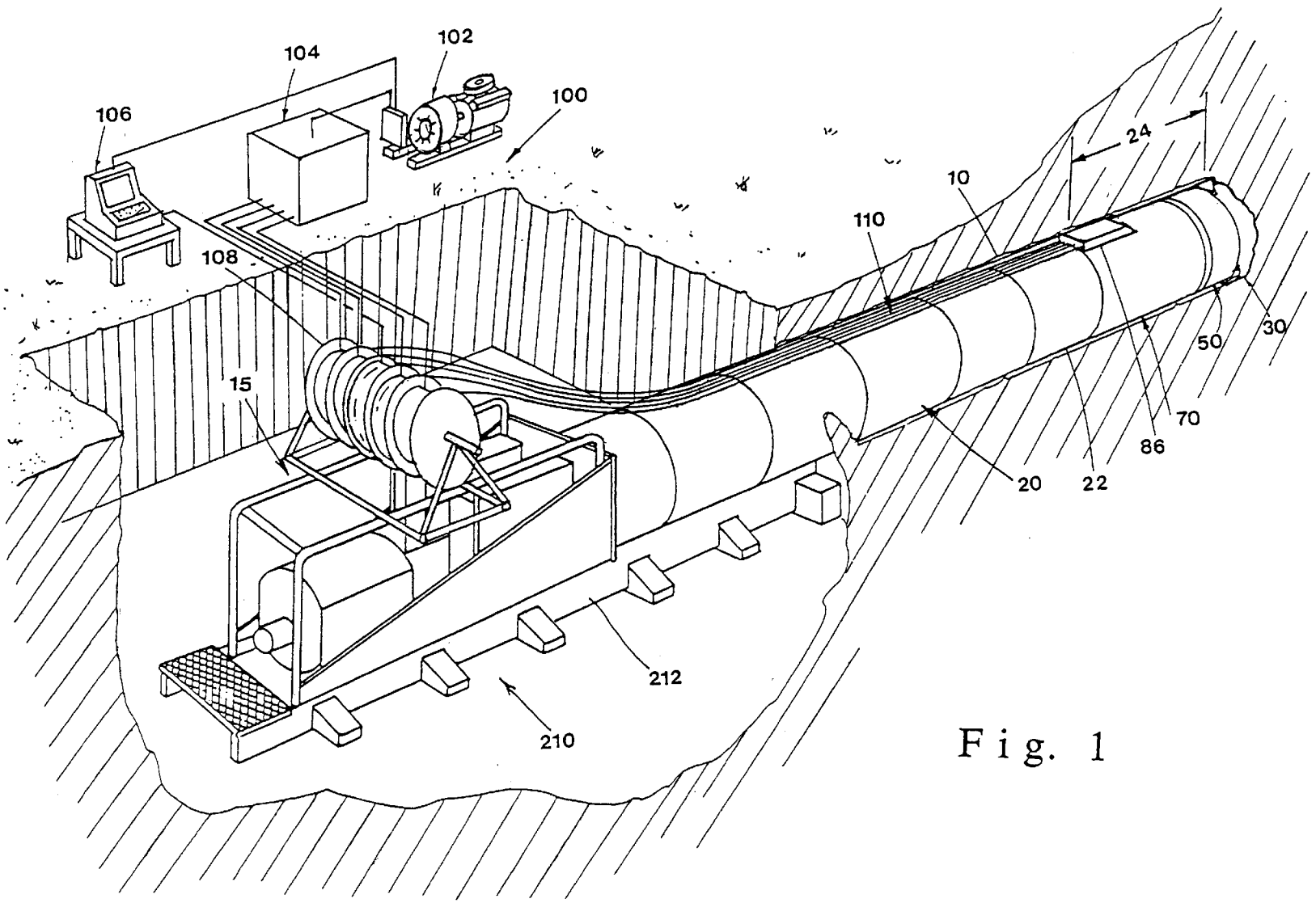
FIG. 1 is a perspective view of an earth boring system showing the boring end assembly and service assembly of this invention.

The earth boring system is illustrated in FIG. 1. A mechanical power unit 15 is forcing a string of pipe casings 20 into an earthen bore 10. A cutter head 30 is used for cutting the earth to provide the earthen bore for the string of pipe casings. A boring end assembly 24 is located in front of a lead pipe 22 of the pipe casings 20 for guiding the string of pipe casings to reach the terminal end of the cased bore hole. The boring end assembly has a front casing 70 in front of the lead pipe and a steering head 50 is positioned in front of the front casing for guiding the direction of the advancing string of pipe casings.

A service assembly 100 is associated with the mechanical power unit 15 to provide service lines 100 for operating the boring end assembly 24 and for lubricating the pipe casings as they are forced into the earthen bore 10. Fluids are also provided by the service lines for lubricating the removal of excess earth produced by the cutter head 30. An electrical power generator 102 provides power to operate a hydraulic unit 104 and a computer control center 106. The hydraulic unit provides hydraulic fluids for a fluids portion of the service lines supplying the boring end assembly. The computer control center monitors electrical signals from the boring end assembly and provides electrical control signals for an electrical current portion of the service lines supplying the boring end assembly. Service lines 110 are extended to the boring end assembly by a service reel assembly 108 that adjusts the required length of the service lines to reach the boring end assembly as the installation proceeds. Service lines 110 enter the boring end assembly through a service line box 86 located on top of the front casing 70.

Figure 2A:
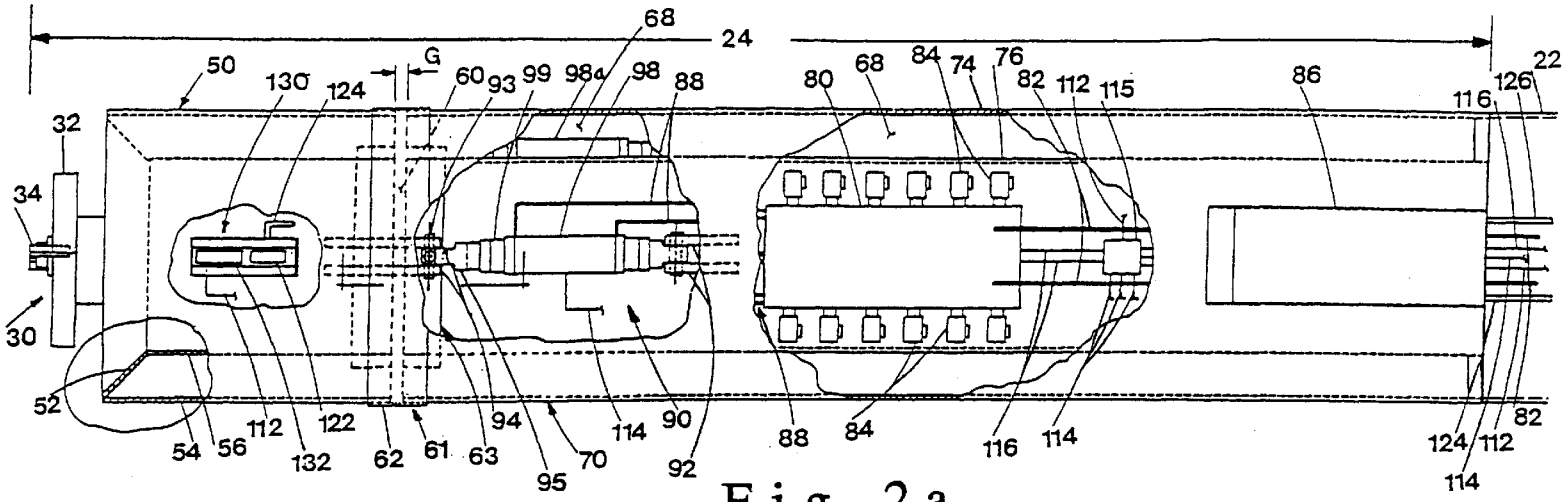
FIG. 2*a* is a top view of the boring end assembly with cutouts to show a hinge assembly, an actuator assembly, service lines and the like of this invention.
Figure 2B:
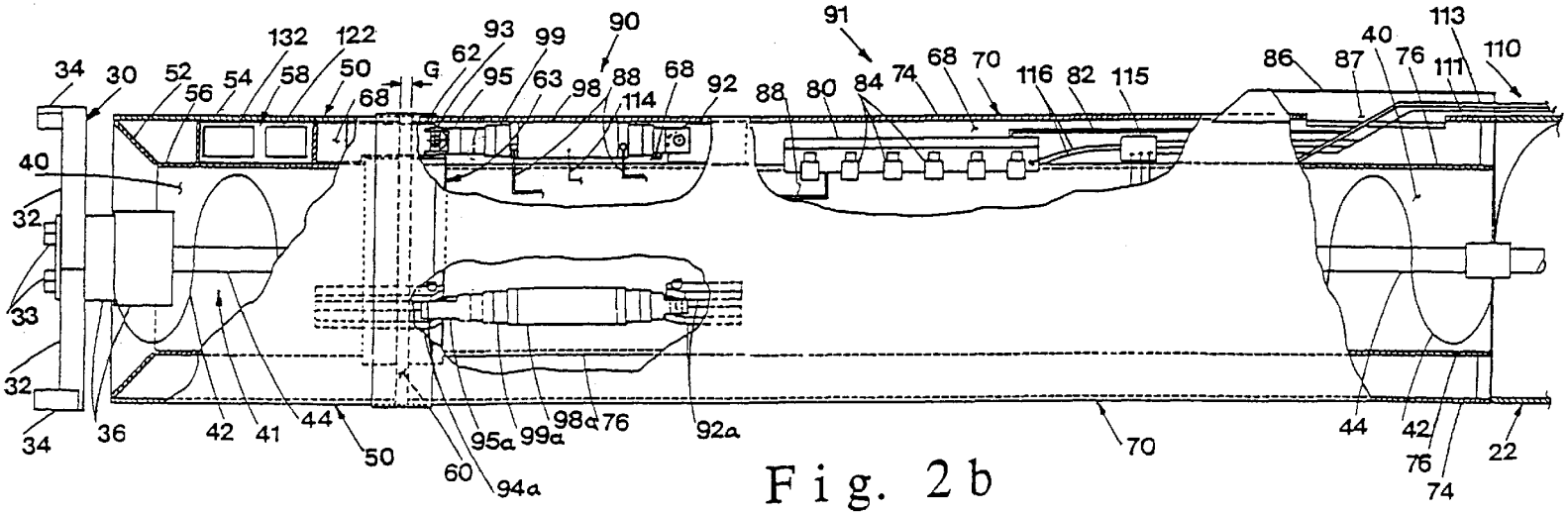
FIG. 2*b* is a side view of the boring end assembly with cutouts to show a hinge assembly, a manifold assembly, service lines and the like of this invention.

The boring end assembly 24 has a combination of components essential to the operation of earth boring system. A top view of the boring end assembly is illustrated in FIG. 2*a* and a side elevation view of the boring end assembly is illustrated in FIG. 2*b*. The front casing 70 is directly connected to the lead pipe 22 of the string of pipe casings. The steering head 50 is positioned in front of the front casing to provide an interface gap 60 which can vary in its extent during installation of the string of pipe casings for guidance of the string of pipe casings.

Figure 5:
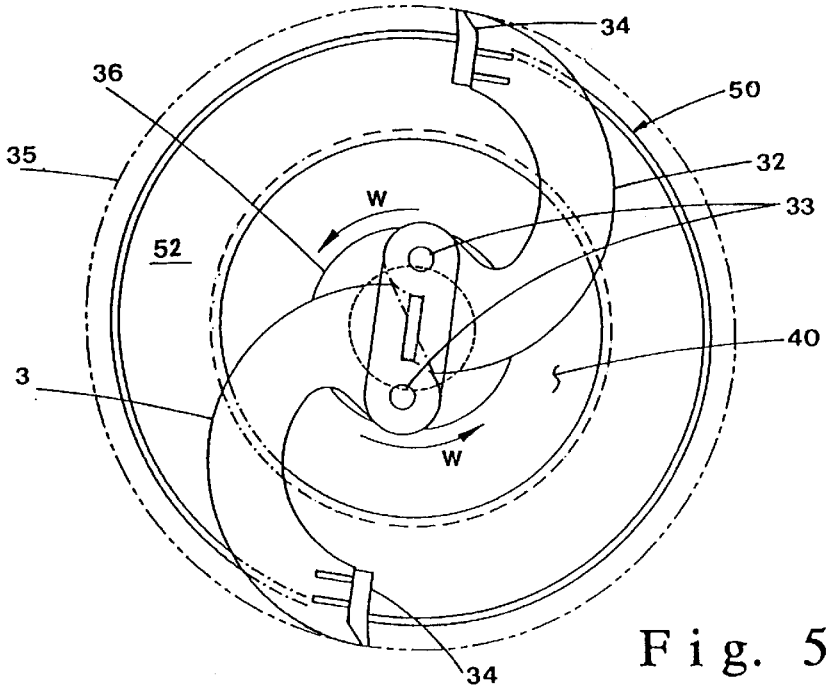
FIG. 5 is an end view of the boring end assembly showing a cutter head and an earth removal channel of the invention.

A cutter head 30 is positioned in front of the steering head to remove earth and produce the earthen bore for installation of the string of pipe casings. The cutter head comprises a number of cutter blades or cutters 34 positioned radially along two swing arms or cutter arms 32. The cutters loosen the earth so that excess earth from cutting the earthen bore can be removed through an earth removal channel 40 to the interior of the steering head, the front casing and the string of pipe casings. Removal of excess earth can be by any convenient means known in the industry. The preferred means of this invention is by an auger 42 supported and rotated by a rotating auger shaft 44 within the earth removal channel 40. The auger shaft is connected to and rotated by the mechanical power unit. The cutter head 30 is also supported and rotated by the auger shaft having a cutter head support 36. Details of the cutter head are illustrated in the end view of FIG. 5. During cutting of the earth by the cutter blades 34 the cutter head 30 forms an earthen bore at an outer circumference 35 as illustrated. The swing arms 32 are attached to the cutter head support by swing arm attachments 33 which allow the cutter blades 34 to move radially for removing the cutter head through the earth removal channel 40. This removal operation is achieved by reversing the rotation "W" of the auger shaft to retract the cutter arms for removal. An steering head entrance segment 52 can be provided, as illustrate in FIGS. 2*a* and 2*b*, at the front of leading end of the steering head 50 to funnel the excess earth into the earth removal channel 40.

The interface gap 60 is defined by opposing end faces 60*a* and 60*b* of the front casing and the steering head respectfully. A plurality of hinge assemblies connect the steering head to the front casing at a plurality of locations adjacent the interface gap 60. Preferably there are three hinge assemblies 90, 90*a* and 90*b* positioned at three equally spaced annular locations around the boring end assembly. Three unequally spaced annular locations are also within the scope of his invention. Components of a top hinge assembly 90 are illustrated in FIGS. 2*a* and 2*b*. Each hinge assembly has a first connector part 92 fixed to the front casing 70 and a second connector part 94 fixed to the steering head 50. The connector parts may be affixed by any suitable means such as by welding. The position of the second connector part relative to the first connector part determines the extent of the interface gap width G (see FIGS. 3*a* and 3*b*). The gap width is directly related to the position of the steering head relative to the front casing.

Figure 4:
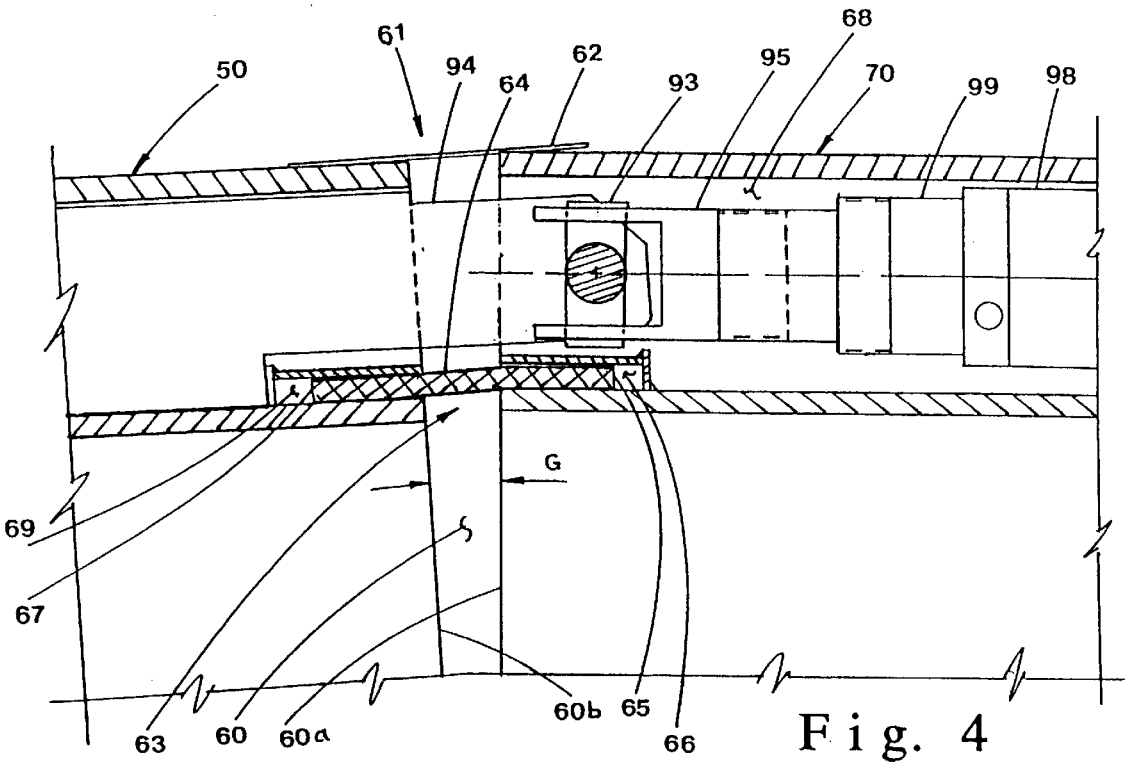
FIG. 4 is a partial section view adjacent an interface gap between a front casing and a steering head of the invention cut along line 4—4 in FIG. 2.

Details of a preferred hinge assembly at an interface gap are illustrated in FIG. 4. The opposed end faces 60*a* and 60*b* of the front casing 70 and the steering head 50 respectively form the interface gap 60. The hinge 93 of the hinge assembly is located adjacent the interface gap 60 to allow for relative displacements of the steering head 50 from the front casing 70 without misalignment at the interface gap. Misalignment can produce a large interface gap width G exposing the hinge assembly to surrounding earth that may limit its effectiveness. The hinge is carried by the second connector part which is attached to the steering head in the preferred embodiment illustrated. The hinge is forced to be displaced relative to the interface gap thereby moving the steering head relative to the front casing. The force is applied by an actuator 98 and an actuator shaft 99 transmits forces to the hinge from the actuator. The end of the actuator shaft has a front hinge part 95 to connect to a hinge 93. The preferred hinge is a dual-axis connector pin to provide for rotations of the second connector part about two axes.

A protective enclosure 61 keeps the hinge assembly from exposure to the earth. A preferred protective enclosure is illustrated in FIG. 4. A closure ring 62 protects the hinge assembly at the outer walls of both the steering head and the front casing by bridging the interface gap. A retainer ring assembly 63 protects the hinge assembly at the inner walls of both the steering head and the front casing by bridging the interface gap. The retainer ring assembly includes an annular retainer belt 64 which slidably engages a first annular pocket 66 of the front casing and second annular pocket 68 of the steering head.

Figure 3A:
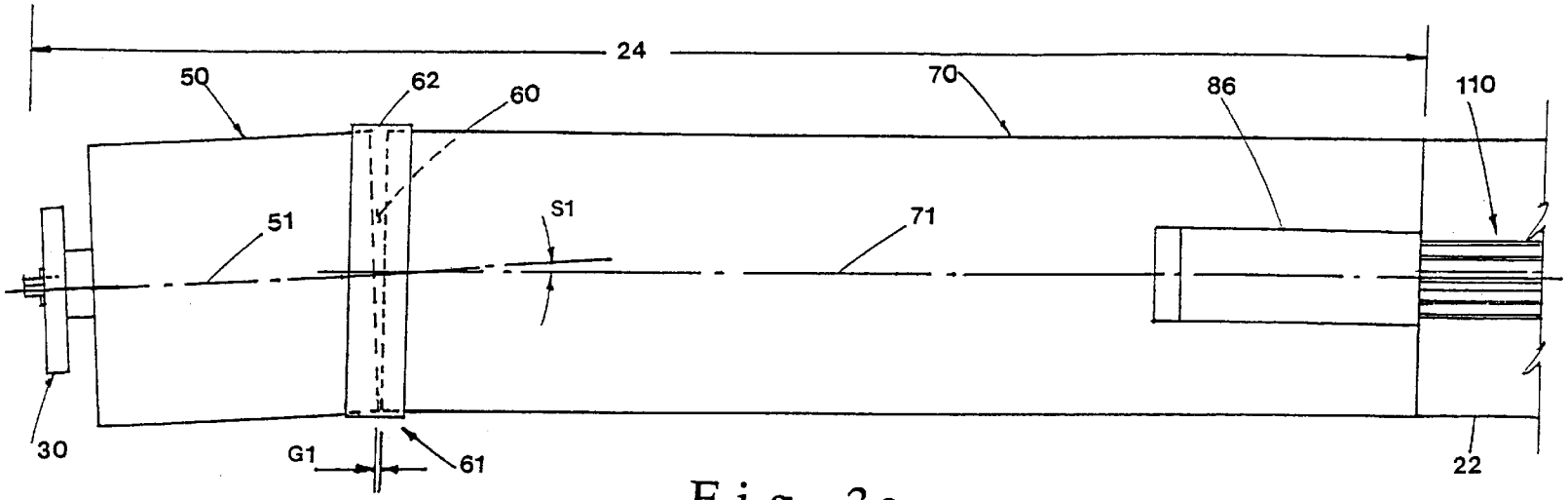
FIG. 3*a* is a top view of the boring end assembly showing the a horizontal steer angle of the steering head.
Figure 3B:
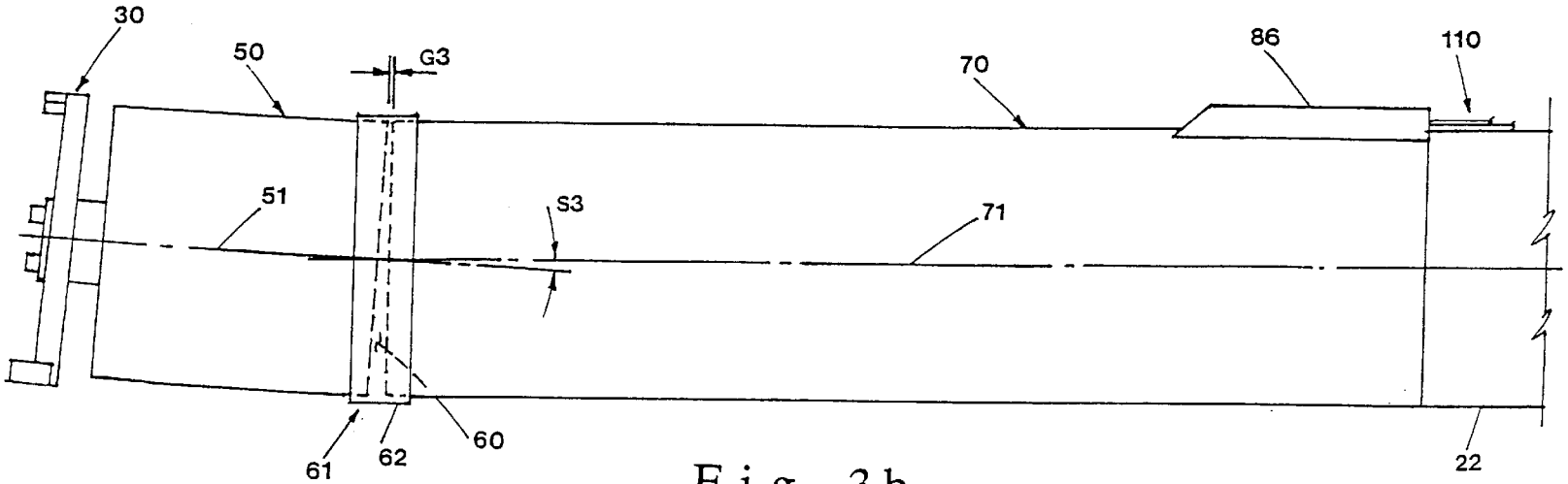
FIG. 3*b* is a side view of the boring end assembly showing a vertical steer angle of the steering head.

A uniform interface gap width (FIGS. 2*a* and 2*b*) is associated with an axial displacement of the steering head 50 relative to the front casing 70 and a non-uniform interface gap width is associated with an angular displacement of the steering head relative to the front casing, as illustrated in FIGS. 3*a* and 3*b*. Axial displacements of the steering head 50 from the front casing 70 are unique to boring end assembly of this invention. As a horizontal angular displacement is introduced, as illustrated in FIG. 3*a*, a horizontal steer angle S1 is developed between the steer axis 51 of the steering head 50 and the central axis 71 of the front casing 70. Axial displacements are introduced for providing a minimum gap width G1 at the interface gap 60 such that the closure ring 62 continues to help provide a protective enclosure 61. In a similar manner, as a vertical displacement of the steering head from the front casing is introduced, as illustrated in FIG. 3*b*, a vertical steer angle S3 is developed between the steer axis of the steering head and the central axis of the front casing. Axial displacements can again be introduced for providing a minimum gap width G3 at the interface gap such that the closure ring continues to help provide the protective enclosure. A horizontal steer angle S1 and a vertical steer angle S3 are orthogonal components of a general steer angle S between the steer axis 51 of the steering head 50 and the central axis 71 of the front casing 70 during guidance of the string of pipe casings 20 by the boring end assembly 24.

The first connector part 92 and the second connector part 94 of each hinge assembly 90 are interconnected. Guidance is realized by displacing first connector parts from second connector parts for providing predetermined steer angles. An actuator 98, an actuator shaft 99, a front hinge part 95 and a hinge 93 are connecting components of the preferred hinge assemblies. The front hinge part 95 is connected to the shaft 99 extending from the actuator 98 as illustrated in FIGS. 2*a* and 2*b*. The actuator is preferably pivotally connected to the first connector part and the front hinge part is preferably connected to the second connector part using the hinge 93. The hinge 93 permits the second connector part to have a rotation with respect to the first connector part about two axes of rotation. A dual-axis connector pin is preferred for the hinge 93.

An axial position of an actuator shaft of each hinge assembly relative to at least one respective connector part is monitored. An electrical signal to represent the axial position is transferred to the computer control center (FIG. 1) by an actuator sensor line 114. A desired position of the first connector part relative to the second connector part is provided by displacing the actuator shaft a predetermined amount by activating a respective actuator. For example, the actuator 98 is activated by a pair of actuator service lines 88. Actuators are preferably hydraulic actuators and actuator service lines transfer hydraulic fluid both to and from the actuators. Any number of hinge assemblies may be used for displacing a respective second connector part from the first connector part. Three actuators 98, 98*a* and 98*b* are preferred for displacing the steering head relative to the front casing during guiding of the string of pipe casings.

The actuator service lines 88 coming from a hydraulic manifold assembly 91 positioned adjacent to the hinge assembly 90 provide a fluid for operating the actuator 98 . A manifold unit 80 of the manifold assembly 91 includes a plurality of solenoid valves 84 which also serve the plurality of actuators 98, 98*a* and 98*b*. Manifold electrical signals are transmitted by manifold electrical service lines 118 to control the amount of fluid provided to each actuator assembly during guiding of the string of pipe casings. The manifold electrical signals are generated by the computer control center 106 (FIG. 1). The manifold assembly 91 is supplied with fluids transmitted by two manifold hydraulic service lines 82 from the hydraulic unit 104 (FIG. 1). The hydraulic manifold unit 80 uniquely requires only two service lines to supply a plurality of actuator assemblies.

Overall guidance and control of the string of pipe casings is provide by sensing the present location and past movements of the front casing and steering head to compute an apparent location of the lead pipe of the string of pipe casings. A guidance sensor package 130 associated with the boring end assembly is for providing electrical guidance signals preferably transmitted by guidance sensor lines to the computer control center 106 at the service assembly 100 (FIG. 1). The computer control center 106 compares the apparent location with a desired location and computes electrical correction signals to transmit to the manifold unit 80 using manifold control lines 116. Guidance sensors are well known in the industry to provide a plurality of lateral positions and a plurality of vertical positions of the string of pipe casings. A water level device 122 supplied by a water service line 124 is commonly used in the industry to indicate the elevation of the lead pipe 22 of the pipe casings. An inertial guidance sensor 132 can be used for sensing pipe movements to provide data for accurately determining the lateral and vertical positions. Other sensor devices are commonly used to generate coded radio frequency waves. These are commonly referred to as walk over or "sonde" devices to determine approximate lateral locations. The preferred guidance sensor package 130 is the inertial guidance sensor 132 commonly known in the industry as using gyros for accuracy in computing the location of the string of pipe casings. The guidance sensor package can be positioned at any convenient location associated with the front casing and the steering head. The preferred location is on the steering head as shown in FIGS. 2*a* and 2*b*.

The existence of any type of opening or gap at an outer wall of a boring end assembly will allow loose earthen material from the earthen bore to gain access to the hinge assemblies and produce operational limitations for the earth boring system. An essential feature of this invention is to enclose at least the hinge assemblies to protect them against any operational limitations both mechanical and electrical. In the present invention a protective enclosure 61 is provided to protect the hinge assemblies, see FIGS. 2*a* and 2*b*. Preferably a closure ring 62 is provided for protecting the hinge assemblies from earthen material displaced from the earthen bore and a retainer belt ring assembly 63 protects the hinge assemblies from excess earth within the earth removal channel 40.

One embodiment of the invention includes both the front casing 70 and the steering head 50 having inner and outer pipes. The front casing includes a first outer pipe 74 and a first inner pipe 76. The steering head includes a second outer pipe 54 and a second inner pipe 56. A continuous annular cavity 68 is formed by axially aligning the first and second outer pipes 74, 54 to form an outer cavity wall and by axially aligning the first and second inner pipes 76, 56 to form an inner cavity wall. Both inner and outer cavity walls help form the protective enclosure 61.

Additional structure is required for providing the preferred protective enclosure adjacent the interface gap 60. FIG. 4 illustrates the preferred structure at the interface gap. The second hinge part 94 is fixed to the steering head 50 and spans the interface gap to connect with the front hinge part 95 of actuator 98 using the dual-axis connector hinge pin 93. The actuator shaft 99 extends to displace the second hinge part 94 from the actuator which is pivotally connected to the first hinge part 92 (FIGS. 2*a* and 2*b*). This displacement causes opposing end faces 60*a* and 60*b* of the interface gap 60 to have a change in their relative position. This change must be accommodated by the additional structure of the protective enclosure. A closure ring 62, preferably attached to the steering head, spans the interface gap at the outer wall of the annular cavity 68. At the inner wall of the annular cavity a retainer belt assembly 63 is formed to help provide the protective enclosure. A first annular pocket 66 of the belt assembly is formed adjacent to a first end face 60*a* of the front casing 70 and a second annular pocket 68 of the belt assembly is formed adjacent a second end face 60*b* of the steering head 50. A retainer belt 64 having a first belt end 65 and a second belt end 67 spans the interface gap 60. The first annular pocket receives the first belt end and the second annular pocket receives the second belt end for retaining the retainer belt to help provide the protective enclosure. The retainer belt is made of a resilient material to allow misalignment between the two inner pipes of the inner wall of the annular cavity. The retainer belt 64 excludes entry of the excess earth from within the earth removal channel 40.

The protective enclosure may also extend to include and protect the manifold unit as well as the sensor package, as illustrated in FIGS. 2*a* and 2*b*. In addition, other means for providing a protective enclosure for the interface gap between the front casing and the steering head are within the scope of this invention. This embodiment of the invention is another unique feature of this invention.

The preferred embodiment of the invention has been described using specific terms, such description is for illustrative purposes only, and it is to be understood that changes and variations may be made without departing from the spirit or scope of the following claims.

What is claimed is:

1. An earth boring system for cutting an earthen bore and installing a string of underground pipe casings joined together to form a cased bore hole in earth by pushing and guiding said string of pipe casings through said earthen bore, said system including:

a mechanical power unit for forcing said pipe casings through said earthen bore;

a front casing disposed directly in front of a lead pipe casing of said string of pipe casings, said front casing including at least an outer front casing wall;

a steering head directly in front of said front casing for guiding said string of pipe casings, said steering head including at least an outer steering head wall;

a cutter head carried forward of said steering head for cutting said earthen bore;

an axially aligned earth removal channel defined through an interior portion of said front casing and said steering head;

a conveyor associated with said cutter head for removing excess earth through said earth removal channel; said conveyor driven within said string of pipe casings by said power unit;

an interface gap defined by opposing end faces of said outer steering head wall and said outer front casing wall to provide for displacements of said steering head relative to said front casing within said earthen bore for guiding said string of pipe casings;

a plurality of hinge assemblies connecting said steering head and said front casing at a plurality of locations adjacent said interface gap for providing relative movements between said steering head and said front casing;

a first connector part of each hinge assembly associated with said front casing;

a second connector part of said each hinge assembly associated with said steering head; and a hinge formed between said first and second connector parts for providing rotations of said steering head relative to said front casing;

a protective enclosure associated with said plurality of hinge assemblies for protecting said hinge assemblies from loose earthen material cut from said earthen bore and from said excess earth moving within said earth removal channel, and said protective enclosure having an enclosure which generally prevents earthen and foreign material originating within the interior of said steering head and front casing from contacting said hinges assemblies as said steering head articulates relative to said front casing;

enclosure elements of said protective enclosure covering said interface gap to exclude said loose earthen material and said excess earth from entry into said protective enclosure; and said enclosure elements including a retainer ring assembly for closing said interface gap adjacent said earth removal channel, and a closure ring for closing said controlled interface gap at an outer pipe adjacent said earthen bore, such that said protective enclosure completely encloses at least said first and second connector parts of said hinge assembly.

2. The system of claim 1 wherein said hinge includes a double-axis pivot having a first and second orthogonal pivot axes about which said steering head rotates.

3. The system set forth in claim 1 wherein each said hinge assembly includes:

an actuator assembly carried by one of said steering head and front casing having an actuator for effecting angular displacements of said steering head relative to said front casing;

a steer axis associated with an axis of symmetry of said steering head, and a central axis associated with an axis of symmetry of said front casing; and said actuator assembly effecting relatively linear displacements between said steering head and said front casing parts so that said interface gap is adjusted and predetermined steer angles between said steer axis and said central axis are controlled.

4. The system set forth in claim 3, wherein said actuator assembly is carried between said first connector part and said hinge.

5. The system set forth in claim 3, wherein said actuator assembly is associated with said first and second connector parts so that said hinge is displaced linearly relative to one of said connector parts to effect said linear displacements of said front casing and said steering head.

6. The system set forth in claim 4, wherein said hinge is formed between said actuator and said second connector part, and said hinge includes a double-axis pivot having two orthognonal pivot axes to provide rotations of said steering head relative to said front casing about two axes of rotation.

7. The system set forth in claim 3, including an manifold assembly for operating said actuators, said manifold assembly comprising:

at least one hydraulic manifold unit for providing hydraulic fluids through supply lines to said each actuator assembly for activation of said actuator assembly for displacing a respective actuator shaft portion relative to said actuators;

manifold hydraulic service lines for piping said hydraulic fluids from a service assembly associated with said mechanical power unit to said manifold unit for operating said manifold unit; and manifold electrical control lines for activating and controlling said manifold unit from said service assembly.

8. The system set forth in claim 7, wherein said service assembly further includes:

an electric generator to provide power for said service assembly;

a hydraulic unit powered by said electric generator for supplying fluids for installing said string of pipe casings;

a computer control module for monitoring and controlling the location of said string of pipe casings using electrical sensor lines for monitoring a plurality of location sensors and electrical control lines to provide control signals for installing said string of pipe casings.

9. The system set forth in claim 1, wherein said cutter head is supported, driven and axially displaced by said conveyor which is rotated and axially forced forward by said mechanical power unit, wherein said cutter head is laterally guided by an interior surface of said steering head contacting said conveyor to move said cutter head laterally.

10. The system set forth in claim 1, wherein said retainer ring assembly includes:

an annular retainer belt axially extending at least through said interface gap, said retainer belt having a first axial end and a second axial end;

a first annular pocket formed within said front casing at said interface gap for slidably receiving said first axial end of said retainer belt; and a second annular pocket formed within said steering head at said interface gap for slidably receiving said second axial end of said retainer belt, said first and second pockets confining said annular retaining belt to bridge said interface gap to help provide said protective enclosure.

11. The system set forth in claim 1, including a computer module having a control system for determining an existing location of said string of pipe casings by monitoring a plurality of guidance sensors and computing an angular displacement and an axial displacement of said steering head relative to said front casing for correcting said existing location of said pipe casings after continued pushing and guiding of said string of pipe casings.

12. The system set forth in claim 1, wherein said steering head includes a conical entrance portion at a front end of said steering head for transporting earth displaced by said cutter head into said conveyor within said earth removal channel.

13. The system set forth in claim 12, wherein said cutter head includes swing arms which allow said cutter head to be withdrawn from said string of pipe casings through said earth removal channel.

14. In an earth boring system for cutting an earthen bore and installing a string of underground pipe casings joined together to form a cased bore hole in earth by pushing and guiding said pipe casings through said bore, a boring end assembly comprising:

a front casing disposed directly in front of a leading pipe of said pipe casings in said cased bore hole, said front casing having a first inner pipe and a first outer pipe;

a steering head directly in front of said front casing for steering said pipe casings, said steering head having a second inner pipe and a second outer pipe;

a continuous annular cavity formed by axially aligning said first and second inner pipes and said first and second outer pipes an outer interface gap associated with said annular cavity defined by opposing end faces of said first and second outer pipes;

an inner interface gap associated with said annular cavity defined by opposing end faces of said first and second inner pipes;

a cutter head carried forward of said steering head for cutting said earthen bore;

an earth removal channel defined through an interior portion of said first and second inner pipes;

a conveyor associated with said cutter head for removing excess earth through said earth removal channel;

a plurality of hinge assemblies at least partially disposed within said annular cavity to connect said steering head and said front casing and provide for axial and angular displacements of said steering head relative to said front casing;

a protective enclosure for protecting said plurality of hinge assemblies from loose earthen material cut from said earthen bore and from excess earth moving within said earth removal channel, said protective enclosure including a portion of said annular cavity in which said hinge assemblies are disposed;

an outer enclosure element of said protective enclosure associated with said outer interface gap to exclude entry of said loose earthen materials into said annular cavity; and an inner enclosure element of said protective enclosure associated with said inner interface gap to exclude entry of said excess earth into said annular cavity.

15. The system set forth in claim 14, wherein said outer enclosure element of said protective enclosure includes a flexible closure ring for bridging said outer interface gap.

16. The system set forth in claim 14, wherein said inner enclosure element of said protective enclosure includes a retainer ring assembly for bridging said inner interface gap.

17. The system set forth in claim 16, wherein said retainer ring assembly includes:

a retainer belt having a first belt end and a second belt end for slidably connecting said first and second inner pipes to bridge said inner interface gap;

a first retainer belt pocket formed adjacent to a first end face of said first inner pipe of said front casing to receive said first belt end; and a second retainer belt pocket formed adjacent to a second end face of said second inner pipe of said steering head to receive said second belt end, said first and second retainer belt pockets retaining said retainer belt during said axial and angular displacements of said steering head relative to said front casing.

18. The system set forth in claim 16, wherein said cutter head is supported by an auger system associated with said earth removal channel, said cutter head having a cutter head assembly to allow said cutter head to adjust from a first diameter larger than an outer diameter of said first and second outer pipes for providing said earthen bore to a second diameter smaller than an inner diameter of said first and second inner pipes to provide for removal of said cutter head from said earth removal channel.

19. The system set forth in claim 18, wherein said second diameter of the cutter head is in a range of about 20 percent to about 45 percent of said first diameter of the cutter head.

20. The system set forth in claim 16, wherein said plurality of hinge assemblies include;

a first connector part disposed between said first inner pipe an said first outer pipe of said front casing;

a second connector part disposed between said second inner pipe and said second outer pipe of said steering head; and a hinge formed between said first connector part and said second connector part.

21. The system set forth in claim 20, including an actuator disposed between said first and second connector parts for causing linear displacements between said steering head and said front casing parts so that the extent of said interface gap can be varied.

22. The system set forth in claim 21 wherein said actuator is disposed between said first and second connector parts for causing angular displacements between said steering head and said front casing parts so that a steer angle can be provided for guiding said string of pipe casings.

23. An earth boring assembly for cutting an earthen bore and installing a string of underground pipe casings joined together to form a cased bore hole in earth by pushing and guiding said pipe casings through said earthen bore, said boring assembly comprising:

a front casing disposed directly in front of a lead pipe casing of said string of pipe casings and having a central axis;

a steering head directly in front of said front casing for guiding said string of pipe casings and having a steer axis;

a cutter head carried forward of said steering head for cutting said earthen bore;

an axially aligned earth removal channel defined through at least an interior portion of said front casing and said steering head;

a conveyor associated with said cutter head for removing excess earth through said earth removal channel, said conveyor being positioned within said string of pipe casings;

an interface gap between said front casing and said steering head for displacing said steering head relative to said front casing within said earthen bore for guiding said string of pipe casings;

a uniform gap width associated with said interface gap for controlling effective steer angles of said steering head relative to said casing;

a plurality of first connector parts associated with said front casing for connecting said steering head to said front casing adjacent said interface gap;

a plurality of second connector parts associated with said steering head for connecting said steering head to said front casing adjacent said interface gap;

a plurality of actuators associated with said front casing and steering head, and an actuator control simultaneously actuating said actuators for causing relative linear axial displacements between said front casing and said steering head to varying a width of said uniform gap; and a plurality of hinges associated with said front casing and said steering head for providing relative angular displacements between said front casing and said steering head about at least one axis of rotation so that said angular displacements are varied with varying said gap width of said interface gap.

24. The assembly of claim 23 wherein said hinge includes a double-axis pivot having a first and second orthogonal pivot axes about which said steering head rotates.

25. The assembly of claim 23 wherein said steer angle is defined between said central axis and said steer axis; and said actuators are constructed and arranged for forcing relatively linear displacements between said steering head and said front casing parts so that said interface gap is adjusted and predetermined steer angles of said steer axis relative to said central axis are controlled.

26. The assembly of claim 25, wherein said actuators are carried between said first connector parts and said hinges.

27. The assembly of claim 26, wherein said actuators are pivotally connected to said front casing.

28. The assembly of claim 26, wherein said hinges are formed between said actuators and said second connector parts, and each said hinge includes a double-axis pivot having two orthognonal pivot axes to provide rotations of said steering head relative to said front casing about two axes of rotation.

29. The assembly of claim 23, further including:

a monitor for monitoring said uniform gap width for controlling a maximum distance of said interface gap width; and at least one of said first and second connector parts being displaced by said actuators for providing a non-uniform gap width, said non-uniform gap width being monitored for controlling said angular displacements defined by said steer angle.

30. The assembly set forth in claim 23 including:

a guidance and control system for monitoring an existing position of said string of pipe casings and for computing a desired angular displacement and a desired axial displacement for directing said string of pipe casings to a desired future position after further installation of said pipe casings; and a service assembly associated with said mechanical power unit for providing a plurality of fluid and electrical service lines for said boring assembly.

31. The assembly set forth in claim 30, wherein said guidance and control system includes:

an guidance sensor package associated with said front casing for sensing the location and movement of said string of pipe casings during installation of said string of pipe casings;

guidance sensor lines extending from said guidance sensor package to said service assembly for monitoring and activating said guidance sensor package; and a computer control center associated with said service assembly for receiving electrical position signals from said guidance sensor lines and computing an electrical correction signal to represent said desired angular displacement.

32. The boring assembly set forth in claim 31, wherein said guidance sensor package includes:

a water level meter for monitoring a vertical location of said front casing relative to said service assembly; and a walk over sonde device for monitoring a lateral location of said front casing relative to a predetermined path of said string of pipe casings.

33. The boring assembly set forth in claim 30, wherein the guidance and control system includes:

actuator sensor lines extending from said plurality of actuators to said service assembly for monitoring and controlling said plurality of actuators; and a computer control center associated with said service assembly for receiving actuator position signals from said actuator sensor lines and computing an actuator correction signal to represent said desired angular displacement and said desired axial displacement of said steering head relative to said front casing.

34. The assembly of claim 23 wherein said actuator control actuates said actuators independently and relative to one another for producing a non-uniformed gap to provide angular displacements of said steering head while controlling said uniformed gap.

* * * * *